United States Patent [19]

Kobayashi

[11] Patent Number: 4,657,519

[45] Date of Patent: Apr. 14, 1987

[54] PLASTIC TOY AND METHOD OF MANUFACTURING SAME

[75] Inventor: Yutaka Kobayashi, 2503, Chazamatsubushi, Matsubushi-cho, Kitakatsushika-gun, Saitama-ken, Japan

[73] Assignees: Yutaka Kobayashi, Saitama; Marukoshi Co., Ltd., Tokyo, both of Japan

[21] Appl. No.: 772,884

[22] Filed: Sep. 5, 1985

[30] Foreign Application Priority Data

May 11, 1985 [JP] Japan ..... 60-69475[U]

[51] Int. Cl.[4] ..... A63H 3/46

[52] U.S. Cl. ..... 446/376; 446/391

[58] Field of Search ..... 446/373, 374, 375, 376, 446/379, 382, 97, 391

[56] References Cited

U.S. PATENT DOCUMENTS 1,940,608 12/1933 Schavoir ..... 446/382
3,590,516 3/1970 Dunn ..... 446/97
4,571,209 2/1986 Manning et al. ..... 446/376 X

FOREIGN PATENT DOCUMENTS 2153904 8/1985 United Kingdom ..... 446/376

*Primary Examiner*—Mickey Yu
*Attorney, Agent, or Firm*—Bachman & LaPointe

[57] ABSTRACT

In manufacturing a toy doll conventionally, for instance, a front half constituting one half of a doll body, a rear half constituting the other half of a doll body and a set of head, hands and legs connected by a molding gate are molded separately. Thereafter, the head, hands and legs are separated from the gate one by one; the separated parts are independently arranged between the two halves one by one before fixing the two halves with the parts sandwiched therebetween. To improve the productivity, the various parts are molded, in connection with plural molding gates, at such positions that these parts are appropriately supported by and/or engageable with the front and rear halves. Therefore, it is possible to assemble the plastic toy doll immediately without separating various parts one by one from the gate before assembling the toy doll. The molding gates may be broken, after assembling, by twisting the hands or legs.

5 Claims, 11 Drawing Figures

PLASTIC TOY AND METHOD OF MANUFACTURING SAME

BACKGROUND OF THE INVENTION

1. Field of the Invention

The present invention relates generally to plastic toys and the method of manufacturing the plastic toys, and more particularly to plastic toy dolls and the method of manufacturing the plastic toy dolls. However, the plastic toy and the method according to the present invention are not limitative to an application to plastic toy dolls only.

2. Description of the Prior Art

The background of the present invention will be explained with respect to its application to toy dolls. As is well known, plastic toy dolls are manufactured by injection molding process. In the conventional method of manufacturing the plastic toy dolls, the main parts constituting the doll head and/or the doll body is molded being divided into two, front and rear, halves. Other movable and/or auxiliary parts are molded being connected by a single common sliding gate. In assembling the plastic toy doll, the movable and/or auxiliary parts should be separated one by one from the common molding gate before assembling the toy doll, and further the parts should be arranged one by one at appropriate positions with respect to the two split halves.

For instance, there exists a toy doll made up of two halves constituting the head and body, movable parts such as the hands and the legs, and auxiliary parts such as the nose and the eyes. In such a toy doll as described above, first the movable parts and the auxiliary parts are separated one by one from the common molding gate; secondary the two halves (head and body) are fixed to each other after the movable parts (hands and legs) have been arranged in position between the two halves; thirdly the other auxiliary parts (nose, eyes) are attached to the two fixed halves by the use of an adhesive agent.

Further, there exists a toy doll made up of two halves constituting the body, and movable parts such as the head, the hands and the legs. In such a toy doll, first the movable parts are separated one by one from the common molding gate; secondary the two halves (body) are fixed to each other after the movable parts (head, hands and legs) have been arranged in position between the two halves.

In any cases, it is very troublesome and costly to manufacture the plastic toy dolls in the conventional method, because all the auxiliary or movable parts must be separated from the common molding gate and arranged to the two halves one by one by the hand by the use of an adhesive agent where necessary. In addition, there exists another problem in that the attached parts may come off and the appearance is not satisfactory.

The conventional method of manufacturing plastic toy dolls will be described in further detail with reference to the attached drawings under DETAILED DESCRIPTION OF THE PREFERRED EMBODIMENTS.

SUMMARY OF THE INVENTION

With these problems in mind, therefore, it is the primay object of the present invention to provide a novel plastic toy and a novel method of manufacturing the plastic toy doll by which it is possible to readily assemble the separately molded parts integrally without use of any adhesive agent or without arranging the auxiliary or movable parts one by one by the hand with respect to the two split halves.

To achieve the above-mentioned object, the plastic toy according to the present invention comprises (a) a pair of front and rear halves so split so as to form a single toy body when mated with each other, said two halves being formed with at least two movable toy parts supporting recesses, respectively, arranged on each outer mated surface thereof so as to provide at least two movable toy parts supporting portions when mated; and (b) a middle parts set having at least two movable toy parts connected by molding gates, the movable toy parts being arranged at such position as to be supported by the at least two movable toy parts supporting portions of said two halves when said two halves are mated to each other with said middle parts set being sandwiched between said two halves, whereby the at least two movable toy parts can be assembled with said two halves without separting the movable toy parts one by one from the molding gates.

Further, to achieve the above-mentioned object, the method of manufacturing a plastic toy according to the present invention comprises the following steps of: (a) molding a front half formed with at least two movable parts supporting recesses on an outer circumference thereof and/or at least two auxiliary parts fitting holes; (b) molding a rear half formed with at least two movable parts supporting recesses on an outer circumference thereof, and at least two auxiliary parts supporting rods, said front and rear supporting recesses constituting respective toy parts supporting portions and said auxiliary toy parts fitting holes being arranged at positions corresponding to said auxiliary toy parts supporting rods; (c) molding a middle parts set having at least two movable toy parts and/or at least two auxiliary toy parts all connected by molding gates being arranged at such positions that the movable toy parts are supported by the at least two movable parts supporting portions of said two halves and/or that the auxiliary toy parts are fitted into the auxiliary parts holes formed in said front half and supported by the auxiliary parts supporting rods formed in said rear half when said two halves are mated to each other with said middle doll parts set being sandwiched between said two halves; (d) assembling said middle parts set with said front half by positioning each movable doll parts formed in said middle parts set at each movable parts supporting recess formed in said front half and/or by fitting each auxiliary doll parts formed in said middle parts set into each auxiliary toy parts fitting hole formed in said front half; and (e) fixing said rear half to said front half with said middle parts set being sandwiched between said two front and rear halves.

In summary, the movable and aixiliary toy parts are molded together being connected by plural molding gates at such positions that these parts can appropriately be arranged with respect to the two split halves. Therefore, the toy parts can be assembled with the two halves without need of separation of the toy parts from a common molding gate and of rearrangement of the toy parts in the two split halves.

BRIEF DESCRIPTION OF THE DRAWINGS

The features and advantages of the plastic toy doll according to the present invention over the prior-art toy doll will be more clearly appreciated from the following description of the preferred embodiments of the invention taken in conjunction with the accompanying drawings in which like reference numerals designate the same elements or parts throughout the figure thereof and in which.

DETAILED DESCRIPTION OF THE PREFERRED EMBODIMENTS

To facilitate understanding of the present invention, a brief reference will be made to a prior-art method of manufacturing a toy doll with reference to the attached drawings.

Figure 1A:
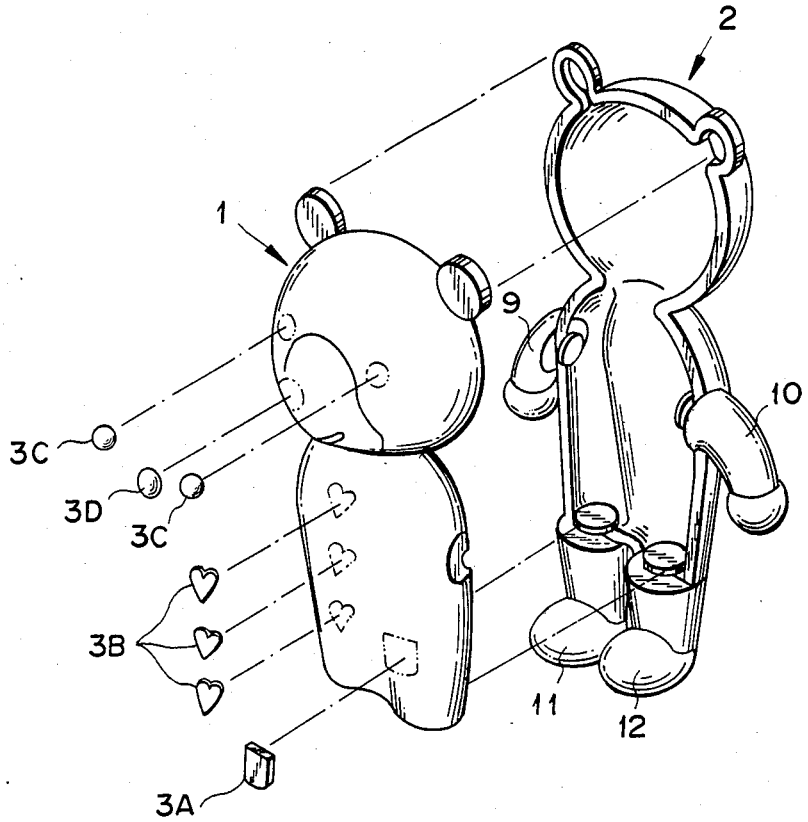
FIG. 1A (PRIOR ART)
FIG. 1A is a perspective exploded view showing a first example of plastic toy dolls for assistance in explaining the conventional method of manufacturing a plastic toy.

In a first example of toy dolls shown in FIG. 1A, the toy doll is made up of two main parts 1 and 2 such as front half and rear half, a pair of doll hands 9 and 10, a pair of doll legs 11 and 12, and a number of auxiliary parts 3A, 3B, 3C and 3D. The front half 1 constitutes a front part of the doll head and the doll body; the head half 2 constitutes a rear part of the doll head and the doll body. The two halves 1 and 2 are hollow plastic parts so split as to be mated with each other to form a complete doll head and body by the use of an adhesive agent.

Figure 1B:
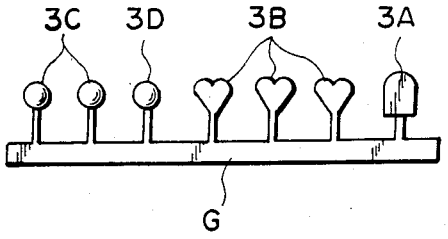
FIG. 1B (PRIOR ART)
FIG. 1B is a plan view showing a number of auxiliary two parts to be attached to the toy doll shown in FIG. 1A, which are all so connected to each other through a common molding gate as to be moldable by a single molding process.

The doll hands 9 and 10 and the legs 11 and 12 are molded separately and pressure fitted to each supporting recess formed at the split surface of the rear half 2. The auxiliary parts are a pocket 3A, three buttons 3B, two eyes 3C and a nose 3D, for instance. These auxiliary or decorating parts are fixed to adhered to the front half 1 separately one by one with an adhesive agent by the hand at the positions shown in FIG. 1A. the auxiliary parts are molded together by a single molding step in the manner as shown in FIG. 1B. That is, these auxiliary parts are molded as a single parts being connected by a single molding gate G through which molten plastic material is injected for injection molding.

In assembling this toy doll, the two halves 1 and 2 are fixed to each other after the doll hands 9 and 10 and the doll legs 11 and 12 have been fitted to the rear half 2 in position. Thereafter, the other auxiliary parts 3A, 3B, 3C and 3D are all attached on the front half 1 in position. To fix the plastic parts, an appropriate adhesive agent is used.

Figure 2A:
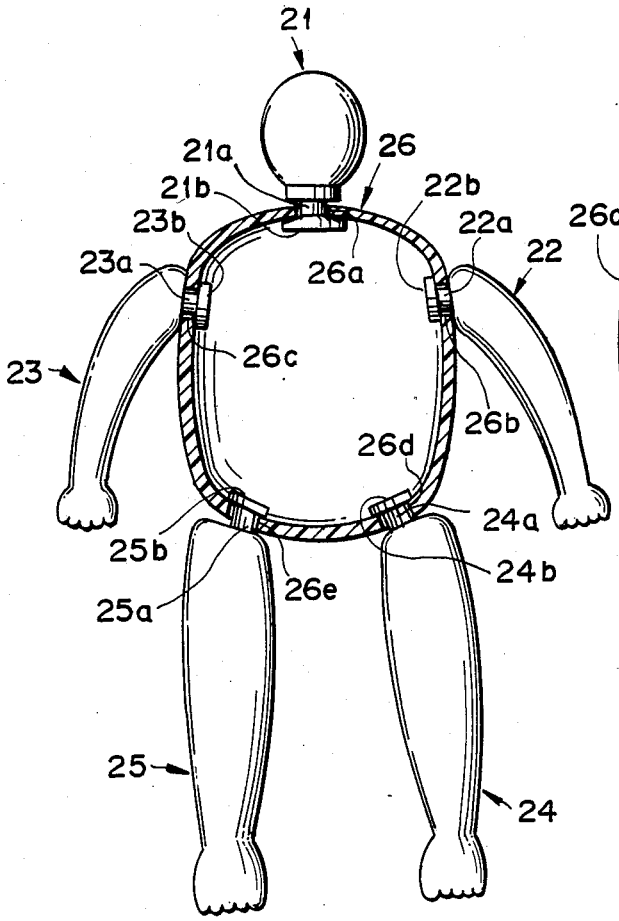
FIG. 2A (PRIOR ART)
FIG. 2A is a front view, partly in cross section, showing a second example of plastic toy dolls for assistance in explaining the conventional method of manufacturing a plastic toy.

In a second example of toy dolls shown in FIG. 2A, the toy doll is made up of two main parts 26 and 26' such as front half and rear half and a number of movable doll parts 21, 22, 23, 24 and 25. The front half 26 (not shown) constitutes a front part of the doll body; the rear half 26' constitutes a rear part of the doll body. The two halves 26 and 26' are hollow plastic parts so split as to be mated with each other to form a complete doll body. The movable parts are a head 21, a pair of left and right hands 22 and 23, and a pair of left and right legs 24 and 25.

The head 21 is formed with an axle portion **21*a* and a flange portion 21*b*; the left hand 22 is formed with an axle portion 22*a* and a flange portion 22*b*; the right hand 23 is formed with an axle portion 23*a* and a flange portion 23*b*; the left leg 24 is formed with an axle portion 24*a* and a flange portion 24*b*; and the right leg 25 is formed with an axle portion 25*a* and a flange portion 25*b***, respectively, at each end portion thereof.

Figure 2B:
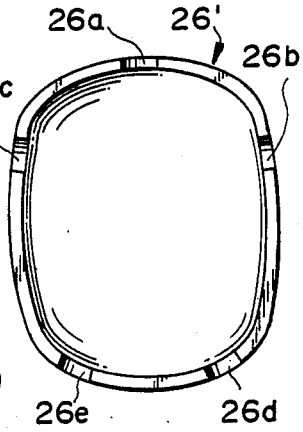
FIG. 2B (PRIOR ART)
FIG. 2B is a side view showing one half of two split halves to be assembled in the second example of the plastic toy dolls shown in FIG. 2A.
Figure 2C:
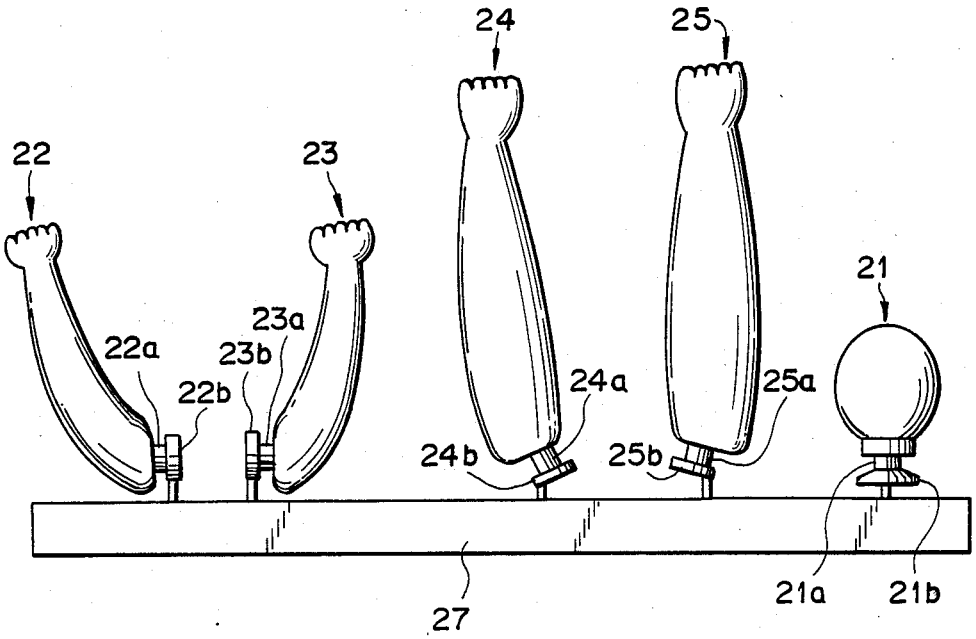
FIG. 2C (PRIOR ART)
FIG. 2C is a plan view showing a number of movable parts to be assembled to the toy doll shown in FIG. 2A, which are all so connected to each other by a single molding gate as to be moldable by a single molding process.

The front and rear halves 26 and 26' constituting a doll body are formed, respectively, with five semi-circular recesses **26*a*, 26*b*, 26*c*, 26*d* and 26*e* in the circumference thereof as depicted in FIG. 2B. These movable doll parts are molded together by a single molding process in the manner as shown in FIG. 2C**. That is, these movable doll parts are molded as a single parts being connected by a single molding gate G through which molten plastic material is injected for injection molding.

In assembling this toy doll, a number of the movable doll parts 21, 22, 23, 24 and 25 are all arranged around one of the two front and rear halves 26 and 26' by fitting each axle portion **21*a*, 22*a*, 23*a*, 24*a* and 25*a* of the movavle doll parts to each semi-circular recess 26*a*, 26*b*, 26*c*, 26*d*, and 26*e* separately, before mating a pair of the two halves 26 and 26'**.

In the prior-art method of manufacturing a toy doll, however, there exist some shortcoming such that the assembling process takes much time and trouble and therefore is costly. The basic problems are: (1) the auxiliary parts 3A, 3B, 3C and 3D or the movable parts 21, 22, 23, 24 and 25 must be cut off from the molding gate G or 27 one by one; (2) the separated movable parts or auxiliary parts must be arranged at the circumference of one of the two halves one by one or adhered to one of the two halves one by one by the hand by the use of an adhesive agent; (3) the adhered auxiliary parts may come off from the toy doll and additionally the appearance is not so good because the auxiliary parts are fixed with an adhesive material.

Figure 3A:
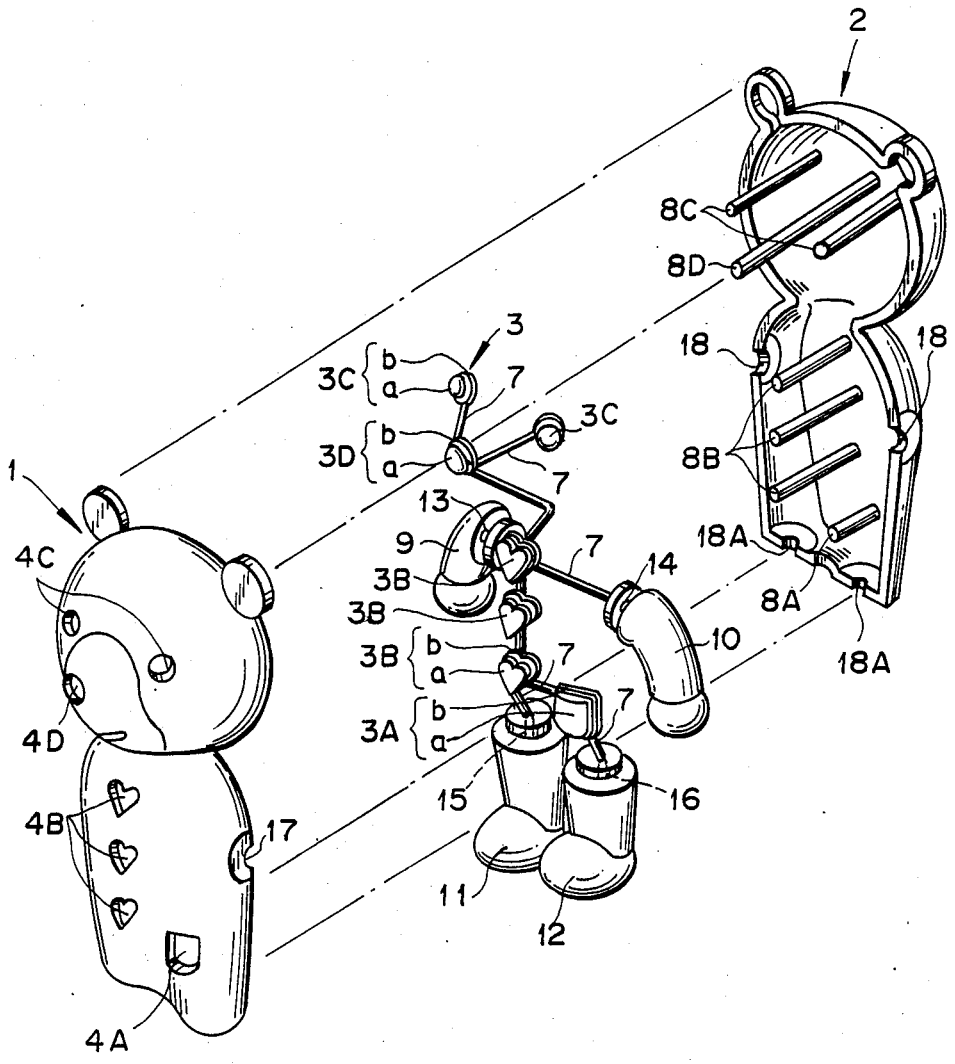
FIG. 3A is a perspective exploded view showing the first example of plastic toy dolls for assistance in explaining the method of manufacturing a plastic toy according to the present invention.
Figure 3B:
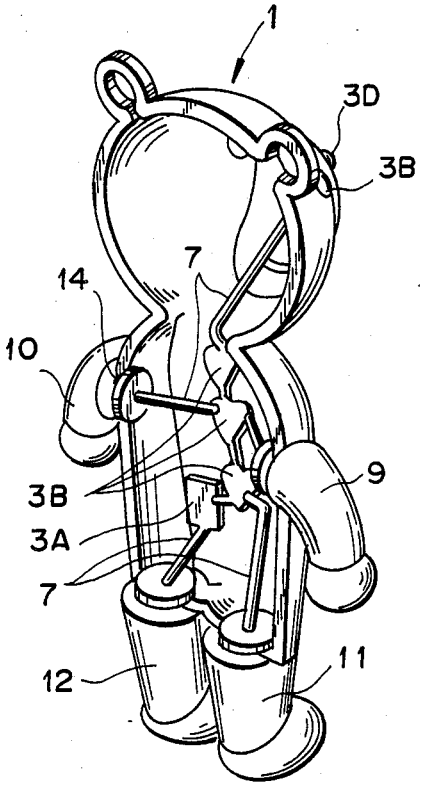
FIG. 3B is a perspective view showing the first example of plastic toy dolls shown in FIG. 3A for assistance in explaining the semi-assembled state obtained on the basis of the method according to the present invention.
Figure 3C:
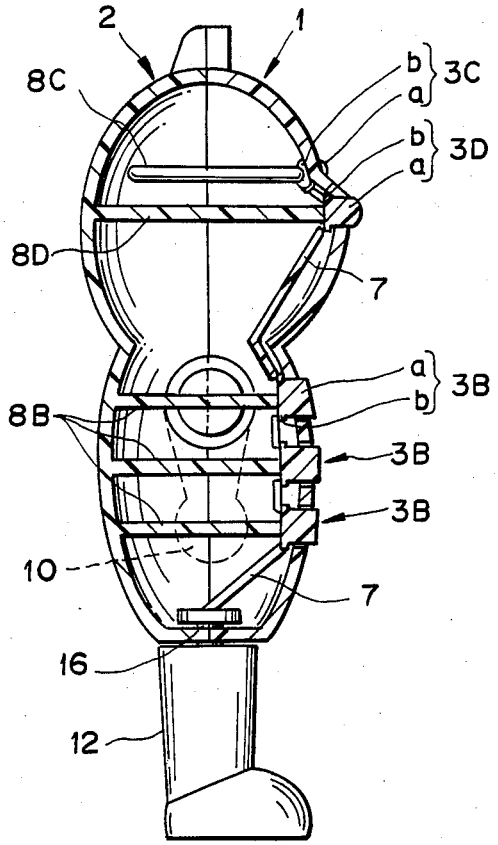
FIG. 3C is a side elevational view, partly in cross section showing the first example of plastic toy dolls shown in FIG. 3A for assistance in explaining the assembled state obtained on the basis of the method according to the present invention.

In view of the above description, reference is now made to a first embodiment of plastic toy dolls manufactured in accordance with the method according to the present invention, with reference to FIGS. 3A, 3B and 3C.

The toy doll is roughly made up of a front half 1, a rear half 2 and a middle doll parts set 3. The front half 1 constitutes a front part of the doll head and doll body; the rear half 2 constitutes a rear part of the doll head and the doll body. The two halves 1 and 2 are hollow plastic parts so split as to form a single toy head and body when fixed to each other by the use of an adhesive agent or with fastening screws.

Being different from the prior-art halves shown in FIG. 1A, the front half 1 is formed with a number of holes 4A, 4C, 4B, and 4C into which the auxiliary doll parts are fitted from the inside of the split doll body. These auxiliary doll parts holes are a pocket hole 4A, three button holes 4B, two eye holes 4C and a nose hole 4D, for instance. The rear half 2 is formed with a number of auxiliary doll parts supporting rods 8A, 8B, 8C and 8D by which the auxiliary doll parts are pushed from the inside of the split doll body for prevention of removal of the auxiliary doll parts. Further, the reference numeral 17 denotes a pair of semi-circular recesses formed on the mated surface of the front half 1 to pivotably support the doll hands 9 and 10; the reference numeral 18 denotes a pair of semi-circular recesses formed on the mated surface of the rear half 2 to similarly support the doll hands 9 and 10. Furthermore, the reference numeral 18A denotes a pair of semi-circular recesses formed on the mated surface of the rear half 2 to pivotably support the doll legs 11 and 12. The similar semi-circular recesses are also formed in the front half 1, but not shown.

The middle doll parts set 3 constitutes a pair of doll hands 9 and 10, a pair of doll legs 11 and 12, and a number of auxiliary parts such as a pocket 3A, three buttons 3B, two eyes 3C and a nose 3D. The doll hand 9 or 10 is formed with an axle portion 13 or 14 pivotably engaged with the supporting recesses 17 and 18 formed in the two halves 1 and 2 when assembled. The doll leg 9 or 10 is formed with an axle portion 15 or 16 pivotably engaged with the supporting recesses 18A formed in the two halves 1 and 2 when assembled. The pocket 3A is formed with pocket body portion 3A*a* and a pocket flange portion 3A*b*; the button 3B is formed with a button body portion 3B*a* and a button flange portion 3B*b*; the eye 3C is formed with an eye body portion 3C*a* and eye flange portion 3C*b*; the nose 3D is formed with a nose body portion 3D*a* and a nose flange portion 3D*b*. Each of these auxiliary doll parts body 3A*a*, 3B*a*, 3C*a*, 3D*a* is made in dimensions so as to be fittable into each of the auxiliary doll parts holes 4A, 4B, 4C and 4D. Eacxh of these auxiliary doll parts flange portions 3A*b*, 3B*b*, 3C*b*, 3D*b* is made in dimensions larger than those of the auxiliary doll parts holes 4A, 4B, 4C and 4D, so that the doll parts can securely be urged in the inner surface of the front half 1 by the auxilairy doll prts supporting rods 8A, 8B, 8C and 8D.

Here, it should be noted that in the middle doll parts set 3, all the plural auxiliary doll parts 9, 10, 11, 12, 3A, 3B, 3C, and 3D are arranged at such appropriate positions that these parts 9, 10, 11, 12 are engageable with the supporting recesses 17, 18 and 18A of the rear and front halves 1 and 2 and parts 3A, 3B, 3C and 3D are fittable to the auxiliary doll parts holes 4A, 4B, 4C and 4D of the front half 1, and additionally these auxiliary doll parts are all connected by plural molding gates 7 in a predetermined order so as to be moldable by a single molding process.

In assembling the above-mentioned plastic toy doll, first the middle doll parts set 3 is assembled with the front half 1. In this step, each auxiliary doll parts 3A, 3B, 3C or 3D is fitted to each auxilairy doll parts holes 4A, 4B, 4C or 4D and each movable doll parts such as the hands 9 and 10 and the legs 11 and 12 are fitted to the supporting recesses 17 with the hand axle portions 13 and 14 and the leg axle portions 15 and 16 engaged therewith. The above-mentioned semi-assembled toy doll is well depicted in FIG. 3B. Secondary, the rear half 2 is assembled with the front half 1 by fixing the front and rear halves by the use of an appropriate adhesive agent or with fastening screws. Here, it should be noted that each auxiliary parts supporting rod 8A, 8B, 8C or 8D supports each corresponding auxiliary doll parts 4A, 4B, 4C or 4D from the inside of the toy doll, as depicted in FIG. 3C, when assembled completely.

Further, in this first embodiment, when the hands or legs are twisted after the doll has been assembled, these parts may be broken off from the molding gates 7. However, since these movable parts are all supported by the two halves 1 and 2 with the axle portions 13, 14, 15, 16 being engaged with the supporting recesses 18 and 18A, these parts will not be removed from the doll body.

Figure 4A:
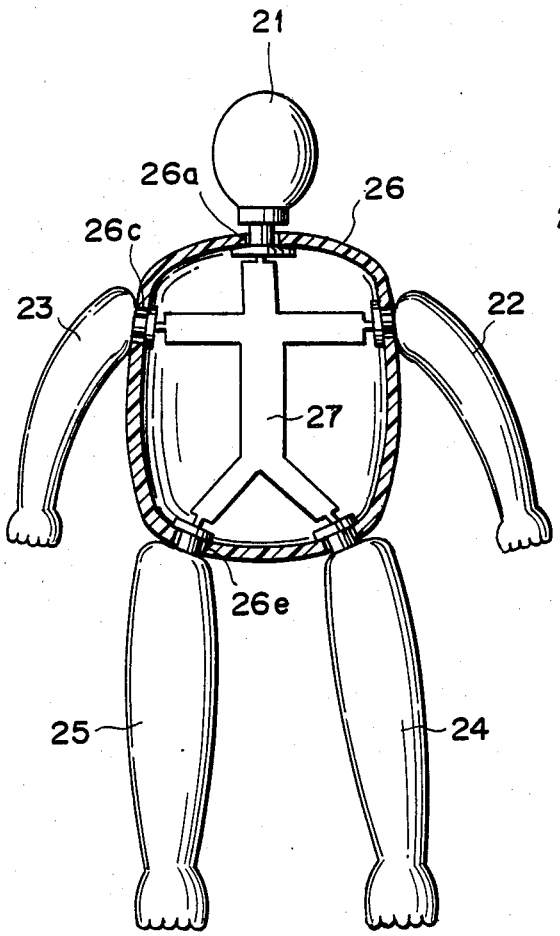
FIG. 4A is a front view, partly in cross section showing the second example of plastic toy dolls for assistance in explaining the method of manufacturing a plastic toy according to the present invention.
Figure 4B:
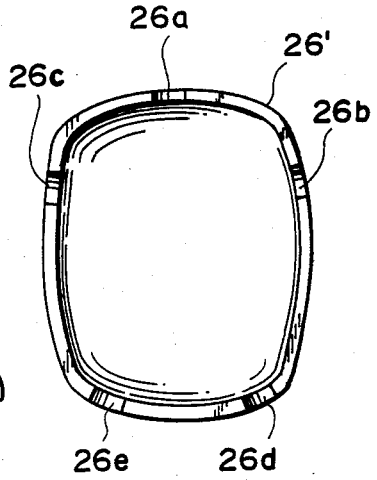
FIG. 4B is a side view showing one half of two split halves to be assembled in the second example of the plastic toy dolls shown in FIG. 4A.
Figure 4C:
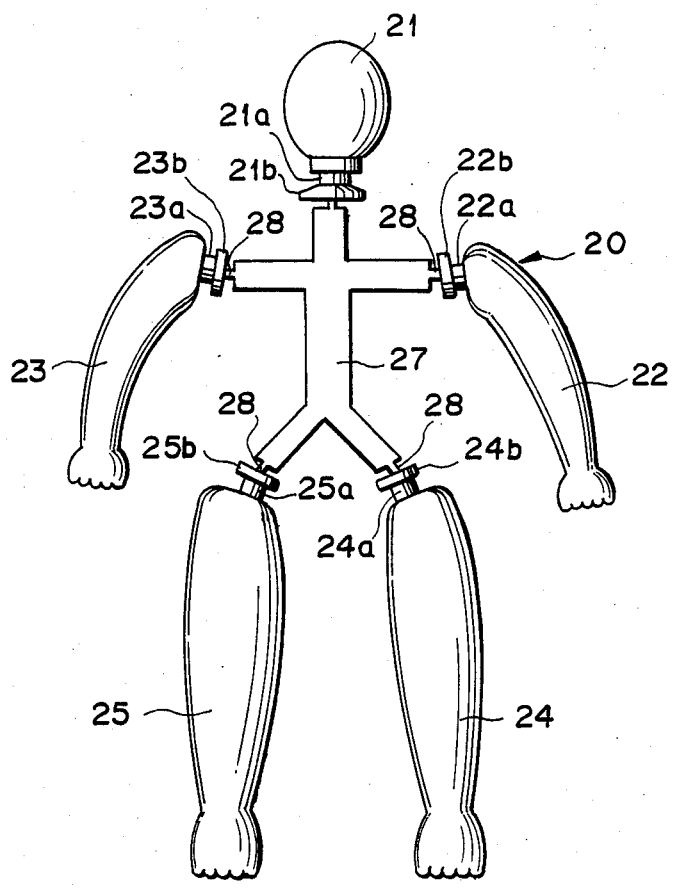
FIG. 4C is a front view showing the movable parts to be assembled in the second example of plastic toy dolls for assistance in explaining the method of manufacturing a plastic toy according to the present invention.

FIGS. 4A, 4B and 4C show a second embodiment of plastic toy dolls manufactured in accordance with the method according to the present invention.

The toy doll is roughly made up of a front half 26 (not shown), a rear half 26' and a middle doll parts set 20. The front half 26 constitutes a front part of the doll body; the rear half 26' constitutes a rear part of the doll body. The two halves 26 and 26' are hollow plastic parts so split as to form a single toy body when mated with each other into a complete body by the use of an adhesive agent or with fastening screws.

In the same manner as in the prior-art toy doll shown in FIG. 2B, the front and rear halves 26 and 26' constituting the doll body are formed, respectively, with five semi-circular supporting recesses 26*a*, 26*b*, 26*c*, 26*d* and 26*e* in the circumference thereof as depicted in FIG. 2B. The middle doll parts set 20 is made up of a doll head 21, a pair of doll hands 22 and 23, and a pair of doll legs 24 and 25. The doll head 21 is formed with an axle portion 21*a* and a flange portion 21*b*; the two doll hands 22 and 23 are formed with two axle portions 22*a* and 23*a* and with two flange portions 22*b* and 23*b*; the two doll legs 24 and 25 are formed with two axle portions 24*a* and 25*a* and with two flange portions 24*b* and 25*b*.

Each of these axle portions 21*a*, 22*a*, 23*a*, 24*a* and 25*a* is made in dimensions so as to be pivotably engageable with each of the supporting recesses 26*a*, 26*b*, 26*c*, 26*d* and 26*e* formed in the two halves 26 and 26' when assembled.

Here, it should be noted that in the middle doll parts set 26, all the plural movable parts 21, 22, 23, 24 and 25 are arranged at such appropriate positions that these parts are engageable with the supporting recesses 26*a*, 26*b*, 26*c*, 26*d* and 26*e* formed in the rear and front halves 26 and 26', and additionally these movable parts are connected by plural molding gates 27 in a predetermined order to as to be moldable by a single molding process. Further, the molding gates 27 are formed with a small-diameter portions 28 for each removal of the movable parts when these parts are twisted.

In assembling the above-mentioned plastic toy doll, the middle doll parts set 20 is assembled being sandwiched by the front and rear halves 26 and 26' with the axle portions 21*a*, 22*a*, 23*a*, 24*a* and 25*a* engaged with the supporting recesses 26*a*, 26*b*, 26*c*, 26*d* and 26*e* formed in the two halves 26 and 26'. The two halves are fixed to each other by the use of an adhesive agent or with fastening screws.

Further, in this second embodiment, since the small-diameter portions are formed in the molding gates 27, when the head, hands or legs are twisted after the doll has been assembled, these parts may be broken off from the gate 27. However, since these movable parts are all securely supported by the supporting recesses 26*a*, 26*b*, 26*c*, 26*d* and 26*e*, these parts will not be removed from the doll body, thus being freely pivotable or movable.

In the above embodiments, the auxiliary doll parts are the doll pocket, the doll buttons, the doll eyes and the doll nose; the movable doll parts are the doll head, the doll hands and the doll legs. However, without being limited these parts, it is possible to select any other parts of doll's belonging such as gun, missile, etc., in the case where the toy doll is a toy robot, for instance.

As described above, in the method of manufacturing the plastic toy according to the present invention, since the middle parts set is formed with a number of auxiliary and movable parts arranged at appropriate positions and connected by molding gates and since the two front and rear halves are formed with plural holes into which the auxiliary parts are fitted, plural supporting recesses by which the movable parts are supported, and plural auxiliary parts supporting rods where necessary, there are various features as follows:

(1) A number of independent auxiliary and movable parts can be assembled together with the two halves without separating these parts one by one from the molding gates;

(2) A number of independent auxiliary parts can be assembled together with the two halves without attaching these parts one by one to the predetermined positions in the half by use of some adhesive agent;

(3) A number of independent auxiliary parts can be assembled together with the two halves without engaging these parts one by one with the supporting recesses of the two halves.

The above features result in a decrease in manufacturing cost and an increase in appearance attractiveness.

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. A plastic toy, which comprises:

(a) a pair of front and rear halves so split as to form a single toy body when mated with each other, said two halves being formed with at least two movable toy parts supporting recesses, respectively, arranged on each outer mated surface thereof so as to provide at least two movable toy parts supporting portions when mated, one of said two halves being further formed with at least one hole into which at least one auxiliary toy parts is fitted, and the other of said two halves being further formed with at least one auxiliary toy parts supporting rod; and (b) a middle parts set having at least two movable toy parts and at least one auxiliary toy parts all connected by molding gates, the movable toy parts being arranged at such positions as to be supported by the at least two movable toy parts supporting portions of said two halves when said two halves are mated to each other with said middle parts set being sandwiched between said two halves, and the auxiliary toy parts being arranged at such a position as to be fitted to the hole formed in one of said two halves and supported by the supporting rod formed in the other of said two halves when said two halves are mated to each other with said middle parts set being sandwiched between said two halves.

2. The plastic toy as set forth in claim 1, wherein a flange portion is formed for each auxiliary parts so that the auxiliary parts may securely be positioned at the holes formed in said half from inside of the toy.

3. A plastic toy doll, which comprises:

(a) a front half constituting one half of a doll head and a doll body, said half being formed with a pair of front doll hand supporting recesses, a pair of front doll leg supporting recesses on an outer circumference thereof, a doll nose hole and a pair of doll eye holes;

(b) a rear half constituting the other half of a doll head and a doll body, said half being formed with a pair of rear doll hand supporting recesses, a pair of rear doll leg supporting recesses on an outer circumference thereof, a doll nose supporting rod and a pair of doll eye supporting rods at positions corresponding to the doll nose hole and the doll eyes holes respectively, the four front and rear supporting recesses constituting doll hand supporting portions and doll leg supporting portions when said front and rear halves are mated with each other; and (c) a middle doll parts set having a pair of doll hands and a pair of doll legs, a doll nose and a pair of doll eyes all connected by molding gates, the four doll parts being arranged at such positions as to be supported by the four supporting portions of said two halves when said front and rear halves are mated to each other with said middle doll parts set being sandwiched between said two halves, said doll nose and said doll eyes being arranged at such positions so as to be fitted to the holes formed in said front half and supported by the supporting rods formed in said rear half when said two front and rear halves are mated to each other with said middle doll parts set being sandwiched between said two halves.

4. The plastic toy doll as set forth in claim 3, wherein said front half is further formed with plural auxiliary holes; said rear half is further formed with plural auxiliary toy parts supporting rods at positions corresponding to the auxiliary parts hole; and said middle doll parts set has plural auxiliary doll parts connected by molding gates, and auxiliary doll parts being arranged at such positions so as to be fitted to the auxiliary holes formed in said front half and supported by said auxiliary toy parts supporting rods formed in said rear half when said two front and rear halves are mated to each other with said middle parts set being sandwiched between said two halves.

5. The plastic toy doll as set forth in claim 4, wherein said auxiliary doll parts are plural buttons and at least one pocket.

* * * * *